US008109196B1

(12) United States Patent
Spence

(10) Patent No.: US 8,109,196 B1
(45) Date of Patent: Feb. 7, 2012

(54) CLEANOUT PORT FOR GAS-OPERATED FIREARMS

(76) Inventor: Jeffery D. Spence, Linden, TN (US)

( * ) Notice: Subject to any disclaimer, the term of this patent is extended or adjusted under 35 U.S.C. 154(b) by 0 days.

(21) Appl. No.: 12/882,510

(22) Filed: Sep. 15, 2010

Related U.S. Application Data

(60) Provisional application No. 61/328,285, filed on Apr. 27, 2010.

(51) Int. Cl.
*F41A 5/18* (2006.01)

(52) U.S. Cl. ..... 89/193

(58) Field of Classification Search ..... 89/193
See application file for complete search history.

(56) References Cited

U.S. PATENT DOCUMENTS 2,845,008 A * 7/1958 Atwood, Jr. ..... 89/193
3,675,534 A * 7/1972 Beretta ..... 89/185
4,244,273 A * 1/1981 Langendorfer et al. ..... 89/193
4,765,224 A 8/1988 Morris
5,272,956 A * 12/1993 Hudson ..... 89/128
5,945,626 A * 8/1999 Robbins ..... 89/193
7,418,898 B1 * 9/2008 Desomma ..... 89/193
7,827,722 B1 * 11/2010 Davies ..... 42/75.02
7,832,326 B1 * 11/2010 Barrett ..... 89/191.01
7,891,284 B1 * 2/2011 Barrett ..... 89/193
7,971,382 B2 * 7/2011 Robinson et al. ..... 42/75.02
7,975,595 B2 * 7/2011 Robinson et al. ..... 89/185
2009/0120277 A1 * 5/2009 Adams ..... 89/179
2010/0101405 A1 * 4/2010 Adams ..... 89/191.01
2011/0023699 A1 * 2/2011 Barrett ..... 89/193

* cited by examiner

*Primary Examiner* — Troy Chambers

(74) *Attorney, Agent, or Firm* — Luedeka, Neely & Graham, PC

(57) ABSTRACT

An improved gas tube system for a firearm having a gas tube with a distal end that is selectively openable to permit access to the distal end of the gas tube for cleaning thereof.

4 Claims, 3 Drawing Sheets

CLEANOUT PORT FOR GAS-OPERATED FIREARMS

CROSS-REFERENCE TO RELATED APPLICATION

This application claims priority to U.S. Provisional Application No. 61/328,285 filed Apr. 27, 2010, and entitled "Hybrid Direct Impingement System allows for a cooler/cleaner upper receiver and allows the gas tube to be cleaned in the currently used AR-15/AR-10 class of weapons," incorporated by reference herein in its entirety.

FIELD

The present disclosure relates to the field of gas operated firearms. More particularly, the disclosure relates to a gas tube configuration that facilitates cleaning of the gas tube.

BACKGROUND

Gas operated firearms, particularly weapons such as the AR-15/AR-10 class of weapons, have a gas tube that receives gas from adjacent the muzzle end of the barrel and routes the gas to utilize the gas to eject the empty cartridge and chamber a fresh cartridge.

As seen in FIG. 1, a conventional gas tube 1 has a solid distal end 2 that is solid and receives a pin 3 within an aperture 4 for attaching the distal end 2 of the gas tube 1 within a front sight/gas block 5 of the firearm. Distal end 6 of the sight 5 is solid. The gas tube, particularly the distal end 2 thereof, can become fouled and cleaning of the gas tube 1 is difficult to accomplish, requiring disassembly of the firearm and removal of the gas tube 1. Even then, the distal end 2 of the gas tube 1 remains difficult to clean. Improvement is desired in the structure and installation of the distal end of the gas tube of gas operated weapons such as the AR-15/AR-10 class of weapons.

The disclosure advantageously provides a gas tube structure that facilitates cleaning of the gas tube and, particularly the distal end of the gas tube, without disassembly of the firearm or removal of the gas tube from the firearm.

SUMMARY

The disclosure relates to an improved gas tube system for a firearm of the type having a gas tube installed within a front sight/gas block of the firearm and in flow communication with a barrel of the firearm for routing a portion of the gas generated by the firing of a cartridge by the firearm through the gas tube for operation of the firearm.

In one aspect, the system includes a gas block having a longitudinal bore extending the length of the gas block; an elongate gas tube having an open distal end positioned within the longitudinal bore of the gas block; and a sealing member removably and sealingly positionable in the open distal end of the gas tube. The sealing member may be removed to enable the distal end of the tube to be selectively closed for operation of the firearm and selectively removed to open the distal end of the gas tube for cleaning of the gas tube.

In another aspect, the disclosure relates to a gas operated firearm. The firearm includes a barrel for passage of a bullet fired from a cartridge by the firearm, the barrel having an open muzzle and a port for routing a portion of gas generated by the firing of the cartridge out of the barrel through the port. The firearm also includes a gas block having a longitudinal bore extending the length of the gas block.

An elongate gas tube having an open distal end is positioned within the longitudinal bore of the gas block, the gas tube being in flow communication with the port of the barrel for routing a portion of the gas generated by the firing of the cartridge by the firearm through the gas tube for operation of the firearm. A sealing member is removably and sealingly positionable in the open distal end of the gas tube to enable the distal end of the tube to be selectively closed for operation of the firearm and selectively opened for cleaning of the gas tube.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
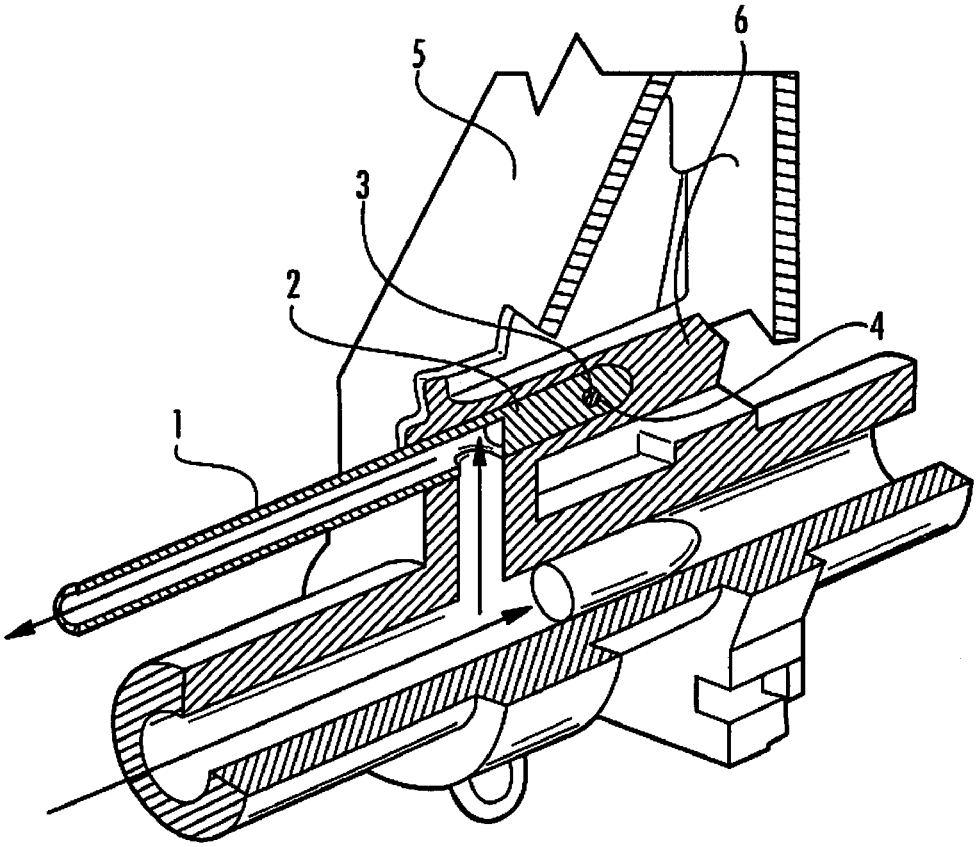
FIG. 1 (PRIOR ART)
FIG. 1 shows a prior art gas tube.
Figure 2:
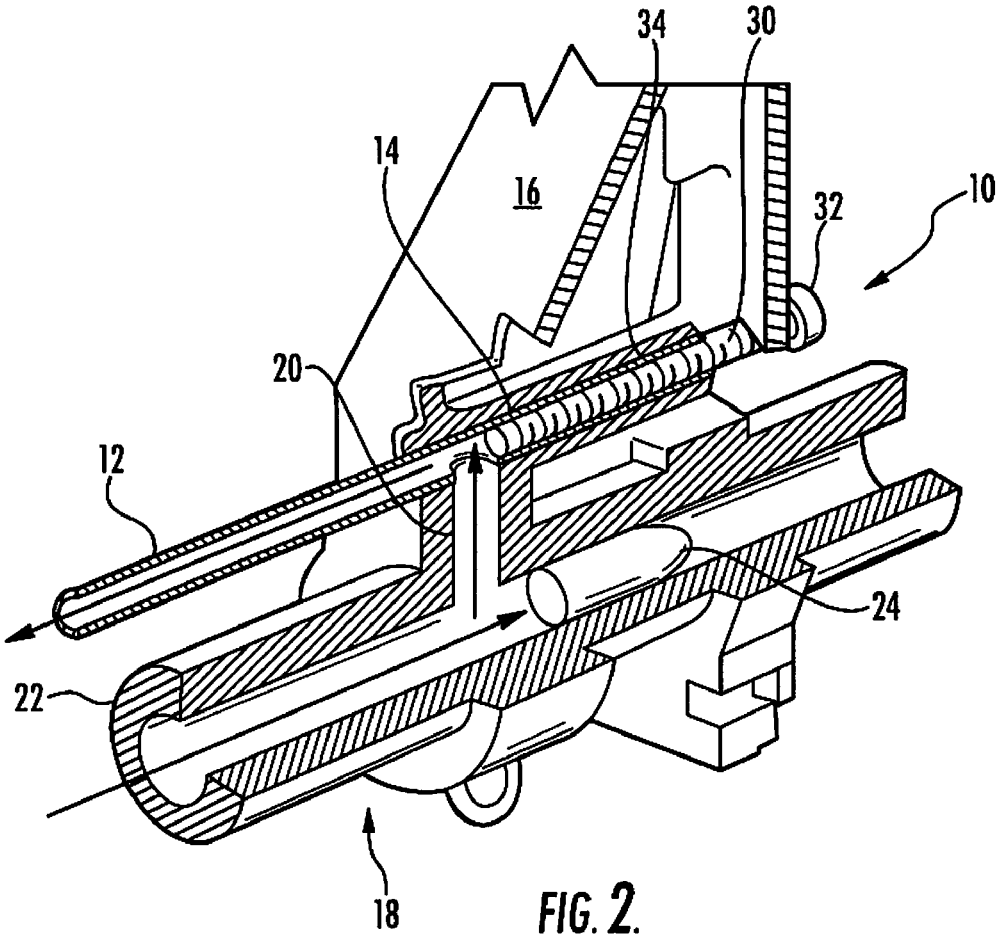
FIGS. 2 and 3 show a gas tube according to the disclosure.
Figure 3:
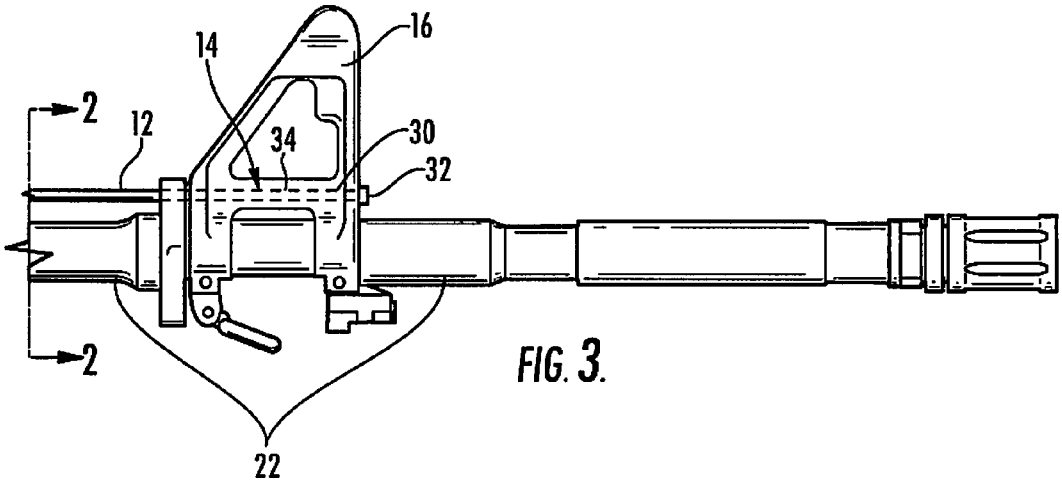

With reference to FIGS. 2 and 3, the disclosure relates to a gas tube system 10 for a gas operated firearm, such as the AR-15/AR-10 class of weapons. The gas tube system 10 is an improvement over conventional gas tube systems, such as shown in FIG. 1. As described previously, the conventional gas tube 1 has distal end 2 that is solid and receives the pin 3 within the aperture 4 for attaching the distal end 2 of the gas tube 1 within the front sight/gas block 5 of the firearm. The gas tube 1, and particularly the distal end 2 of the gas tube 1, can become fouled and cleaning of the gas tube is difficult to accomplish, requiring disassembly of the firearm and removal of the gas tube. Even then, the distal end 2 is difficult to clean.

With reference to FIGS. 2 and 3, the system 10 includes a gas tube 12 according to the disclosure and having a distal end 14 located within a front sight/gas block 16 of a firearm 18. A port 20 within the gas block 16 places the gas tube 12 in flow communication with a barrel 22 of the firearm 18. A portion of the gas generated by the firing of a cartridge by the firearm 18 is routed to the gas tube 12 as a bullet 24 fired by the cartridge is discharged from the barrel 22, as indicated by the arrows.

The distal end 14 of the gas tube 12 is not solid like the distal end 2 of the gas tube 1, but is open in the manner of the remainder of the gas tube 12 so as to be in flow communication with the other portions of the tube 12. However, to enable the distal end 14 of the tube 12 to be selectively closed, in the manner of the solid nature of the distal end 2 of the tube 1, a sealing member 30 is removably and sealingly positionable within the distal end 14 of the gas tube 12.

When the sealing member 30 is installed within the distal end 14, the sealing member 30 functions to seal the distal end 14 against passage of gas therethrough so that gas travels from the barrel 22 via the port 20 and down the gas tube 12 in a direction away from the distal end 14, as shown by the arrows in FIG. 2, thus replicating the travel of gas in the conventional gas tube 1.

However, the sealing member 30 may be selectively removed from the distal end 14 without disassembly of the firearm 18 or removal of the gas tube 12, to provide a path for insertion of a cleaning tool, such as an appropriately sized brush or swab, to permit cleaning of the entire gas tube 12, and particularly the distal end 14, to remove powder residue and other fouling associated with the gas operation of the firearm 18.

For example, the interior of the distal end 14 of the gas tube 12 may be threaded and the sealing member 30 may be provided as by a threaded fastener that may be threaded into the distal end 14 from the distalmost end thereof for sealing the distal end 14 of the tube 12 against the passage of gas therethrough. Removal of the threaded fastener may be easily accomplished as by use of a knurled head 32 or other configuration for use with a tool to turn the fastener for threading and unthreading thereof relative to the distal end 14.

To be compatible with the gas tube 12, the front sight/gas block 16 has a longitudinal bore 34 extending the length of the gas block 16 and sized to fittingly receive the distal end 14 of the gas tube 12. The bore 34 fittingly retains the gas tube 12, yet permits it to be slidingly removed therefrom if desired. In this regard, it will be understood that such weapons include a front gas block configured to route gas from the barrel to the gas tube. In many instances, the gas black is configured as a front sight. However, some firearms configured for use with laser sights do not configure the gas block to have a front sight function. Accordingly, as used herein, the term "gas block" will be understood to refer to a structure that routes gas from the barrel to the gas tube, with or without additional structure to configure the gas block as a sight.

Accordingly, it will be appreciated that the gas tube system 10 advantageously facilitates cleaning of the gas tube and, particularly the distal end 14 of the gas tube 12, without disassembly of the firearm 18 or removal of the gas tube 12 from the firearm 18.

The gas tube system 10 may be installed on a new or existing firearm preferably using a newly manufactured gas tube and a newly manufactured gas block having the described structure. Alternatively, it will be appreciated that the existing gas tube and gas block of a firearm may be modified by drilling the gas tube and the gas block to provide the structure of the disclosure.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An improved gas tube system for a firearm of the type having a gas tube installed within a gas block of the firearm and in flow communication with a barrel of the firearm for routing a portion of the gas generated by the firing of a cartridge by the firearm through the gas tube for operation of the firearm, the improvement comprising:

a gas block having a longitudinal bore extending the length of the gas block;

an elongate gas tube having an open distal end positioned within the longitudinal bore of the gas block; and a sealing member removably and sealingly positionable in the open distal end of the gas tube to enable the distal end of the tube to be selectively closed for operation of the firearm and selectively opened for cleaning of the gas tube.

2. The system of claim 1, wherein the interior of the distal end of the gas tube is threaded and the sealing member comprises a threaded fastener that may be threaded into the distal end from the distalmost end thereof for sealing the distal end of the tube against the passage of gas therethrough, and unthreaded from the gas tube to permit access to the distal end of the gas tube for cleaning of the gas tube.

3. A gas operated firearm, comprising:

a barrel for passage of a bullet fired from a cartridge by the firearm, the barrel including an open muzzle and a port for routing a portion of gas generated by the firing of the cartridge out of the barrel through the port;

a gas block having a longitudinal bore extending the length of the gas block;

an elongate gas tube having an open distal end and positioned within the longitudinal bore of the gas block, the gas tube being in flow communication with the port of the barrel for routing a portion of the gas generated by the firing of the cartridge by the firearm through the gas tube for operation of the firearm; and a sealing member removably and sealingly positionable in the open distal end of the gas tube to enable the distal end of the tube to be selectively closed for operation of the firearm and selectively opened for cleaning of the gas tube.

4. The firearm of claim 3, wherein the interior of the distal end of the gas tube is threaded and the sealing member comprises a threaded fastener that may be threaded into the distal end from the distalmost end thereof for sealing the distal end of the tube against the passage of gas therethrough, and unthreaded from the gas tube to permit access to the distal end of the gas tube for cleaning of the gas tube.

* * * * *